US008525359B2

(12) United States Patent
Nishimura et al.

(10) Patent No.: US 8,525,359 B2
(45) Date of Patent: Sep. 3, 2013

(54) ENGINE GENERATOR

(75) Inventors: Shinji Nishimura, Osaka (JP); Masaru Sakamoto, Gunma (JP); Norikazu Sakata, Gunma (JP)

(73) Assignees: Yanmar Co., Ltd., Osaka (JP); Sawafuji Electric Co., Ltd., Gunma (JP)

( * ) Notice: Subject to any disclaimer, the term of this patent is extended or adjusted under 35 U.S.C. 154(b) by 87 days.

(21) Appl. No.: 13/126,418

(22) PCT Filed: Oct. 27, 2009

(86) PCT No.: PCT/JP2009/068430
§ 371 (c)(1),
(2), (4) Date: Apr. 27, 2011

(87) PCT Pub. No.: WO2010/050480
PCT Pub. Date: May 6, 2010

(65) Prior Publication Data

US 2011/0204651 A1 Aug. 25, 2011

(30) Foreign Application Priority Data

Oct. 28, 2008 (JP) ..... 2008-277335

(51) Int. Cl.
*H02K 5/00* (2006.01)

(52) U.S. Cl.
USPC ..... 290/1 A; 290/1 B

(58) Field of Classification Search
USPC ..... 290/1 A, 1 B
See application file for complete search history.

(56) References Cited

U.S. PATENT DOCUMENTS

| | | | | |
|---|---|---|---|---|
| 6,362,533 | B1 * | 3/2002 | Morohoshi et al. | 290/1 A |
| 2006/0214425 | A1 * | 9/2006 | Yamamoto et al. | 290/1 A |
| 2008/0202447 | A1 * | 8/2008 | Kochi et al. | 123/2 |

FOREIGN PATENT DOCUMENTS

| | | | |
|---|---|---|---|
| JP | 7-30901 | Y2 | 6/1995 |
| JP | 7-30901 | Y2 | 7/1995 |
| JP | 2002-242760 | A | 8/2002 |
| JP | 2005-117808 | A | 4/2005 |
| JP | 2005-299601 | A | 10/2005 |

OTHER PUBLICATIONS

International Search Report for PCT/JP2009/068430, Japanese Patent Office, mailed Dec. 28, 2009, 1 page.

* cited by examiner

*Primary Examiner* — Tho D Ta
(74) *Attorney, Agent, or Firm* — Sterne, Kessler, Goldstein & Fox P.L.L.C.

(57) ABSTRACT

An engine generator is provided having an improved cooling effect realized by cooling air while ensuring a compact arrangement of components in a housing. The engine generator includes an engine 2, a generator 3, an inverter 4, a control device, a fuel tank 7, an air cleaner 16, a muffler 18, a radiator 6, and a housing 5 accommodating the foregoing components. The engine generator includes cooling air inlets 12 and 11 and a cooling air outlet 14 on sides of the housing 5 with a cooling air passage disposed between the inlets and outlet. The generator 3, the inverter 4, and the air cleaner 16 are disposed further upstream than the engine 2 along a cooling air passage. The fuel tank 7, the radiator 6, and the muffler 18 are disposed further downstream than the engine 2 along the cooling air passage. Ambient air is incorporated as cooling air into the housing 5 through the cooling air inlets 12 and 11, allowed to flow from an upstream toward a downstream of the cooling air passage, and discharged to outside the housing 5 through the cooling air outlet 14.

5 Claims, 8 Drawing Sheets

ENGINE GENERATOR

TECHNICAL FIELD

The present invention relates to engine generators including engines and generators driven by the engines, and particularly to an internal structure of an engine generator for enhancing the efficiency of cooling an inverter and an air cleaner to which cooling needs to be effected.

BACKGROUND ART

Conventionally known engine generators accommodate adjacent engines and generators within housings (packages) (see, for example, patent document 1). The engine generators each include an inverter to rectify electrical power generated by the generator and convert the rectified electrical power into a desired frequency. The housing accommodates the engine, the generator, the inverter, and all of other necessary components. Attempts to bring simplicity and compactness to the structure of the necessary components have resulted in ease of handling of the engine generator during installation, transfer, and maintenance.

[Patent Document 1] Japanese Unexamined Patent Application Publication No. 2005-299601.

DISCLOSURE OF THE INVENTION

Problems to be Solved by the Invention

In some of the conventional engine generators, the inverter, which is an electrical component vulnerable to heat, is located approximately at the center inside the housing together with the heat source engine and generator. This provides a possibility of increasing the temperature of the inverter due to heat generated by the heat sources, as well as heat generated by the inverter itself. This may lead electrical circuits into problematic situations including changes in voltage and frequency.

In view of this, it is an object of the present invention to provide an engine generator that improves the cooling effect realized by cooling air while ensuring a compact arrangement of components in the housing.

Means of Solving the Problems

The problems to be solved by the present invention have been described hereinabove, and subsequently, means of solving the problems are described.

According to one aspect of the present invention, an engine generator includes an engine, a generator, at least one inverter, a control device, a fuel tank, an air cleaner, a muffler, a radiator, and a housing. The generator is driven by the engine to generate electrical power. The at least one inverter is configured to convert the electrical power generated by the generator into an alternating current and to output the alternating current. The control device is configured to control the engine and the generator. The fuel tank is to store fuel to be supplied to the engine. The air cleaner is configured to purify air to be supplied to the engine. The muffler is configured to deaden exhaust noise of the engine. The radiator is configured to cool coolant for the engine. The housing accommodates the foregoing components. At least one cooling air inlet is disposed on a first side of the housing corresponding to a first side of the engine. A cooling air outlet is disposed on a second side of the housing corresponding to a second side of the engine. A cooling air passage is disposed in the housing between the at least one cooling air inlet and the cooling air outlet. The generator, the inverter, and the air cleaner are disposed further upstream than the engine along the cooling air passage. The fuel tank, the radiator, and the muffler are disposed further downstream than the engine along the cooling air passage. Upon driving of a cooling fan of the engine by the engine, ambient air is incorporated as cooling air into the housing through the at least one cooling air inlet, allowed to flow from an upstream toward a downstream of the cooling air passage, and discharged to outside the housing through the cooling air outlet.

In the engine generator according to the foregoing aspect of the present invention, the at least one cooling air inlet may include upper and lower first cooling air inlets respectively on upper and lower portions of the first side of the housing. The at least one inverter may include two, upper and lower inverters in the housing and in parallel to the first side of the housing. The upper and lower inverters may be respectively opposite the upper and lower first cooling air inlets. A support may be disposed between and in parallel to the upper and lower inverters and the first side of the housing. The support may include a first duct constituting the cooling air passage. The first duct may extend from the upper and lower first cooling air inlets toward the upper and lower inverters. The cooling air may be allowed to flow through the at least one cooling air inlet into the first duct and may be guided upward and downward along the upper and lower inverters.

The engine generator of according to the foregoing aspect of the present invention may further include a partition in the first duct to vertically split the cooling air from the upper and lower first cooling air inlets. Part of the cooling air flowing into the first duct may be guided upward along the upper inverter. A rest of the cooling air flowing into the first duct may be guided downward along the lower inverter.

In the engine generator according to the foregoing aspect of the present invention, the at least one cooling air inlet may include a second cooling air inlet at a lower portion of a third side of the housing. A guiding member in box form may be disposed in the housing in parallel to the lower portion of the third side of the housing and opposite the second cooling air inlet. The guiding member may have an opening oriented upward and toward the second cooling air inlet. The guiding member may include a second duct constituting the cooling air passage. The second duct may extend from the second cooling air inlet to an upper portion of an interior of the housing. The second cooling air inlet and the second duct may communicate with one another to allow cooling air from the second cooling air inlet to flow into the second duct and be guided upward along the guiding member.

In the engine generator according to the foregoing aspect of the present invention, the radiator may be disposed in parallel to the fuel tank with a longitudinal side of the radiator oriented in a lateral direction and aligned to a longitudinal side of the fuel tank.

Effects of the Invention

The embodiments of the present invention provide the following advantageous effects.

The engine generator according to an embodiment of the present invention ensures cooling of the inverter and the air cleaner, which particularly need cooling, with cooling air of a relatively low temperature. This ensures efficient cooling of the components as necessary, resulting in an improved cooling effect realized by cooling air. Further, the other components are disposed as if to surround the engine. This ensures a compact arrangement of the other components, while reducing noise of the engine with the other components utilized as sound barriers.

The engine generator according to an embodiment of the present invention also ensures that cooling air is sent toward the upper and lower inverters through the first duct. This ensures efficient cooling of the upper and lower inverters with the cooling air, resulting in an improved cooling effect realized by cooling air. Further, the first duct is disposed on the inside relative to the first cooling air inlet. This reduces leakage of noise to outside the housing through the first cooling air inlet.

The engine generator according to an embodiment of the present invention also ensures that cooling air is vertically split into upper and lower inverters and that equal volumes of cooling air are sent toward the upper and lower inverters. This uniformizes cooling of the upper and lower inverters with the cooling air and thus reduces unevenness of the cooling effect utilizing cooling air.

Also in the engine generator according to an embodiment of the present invention, the second duct is disposed on the inside relative to the second cooling air inlet. This reduces leakage of noise to outside the housing through the second cooling air inlet.

The engine generator according to an embodiment of the present invention also ensures as much cooling, capacity of the radiator as desired and increases the capacity of the fuel tank, while ensuring a compact arrangement of the radiator and the fuel tank in the housing.

DESCRIPTION OF THE REFERENCE NUMERAL

Figure 1:
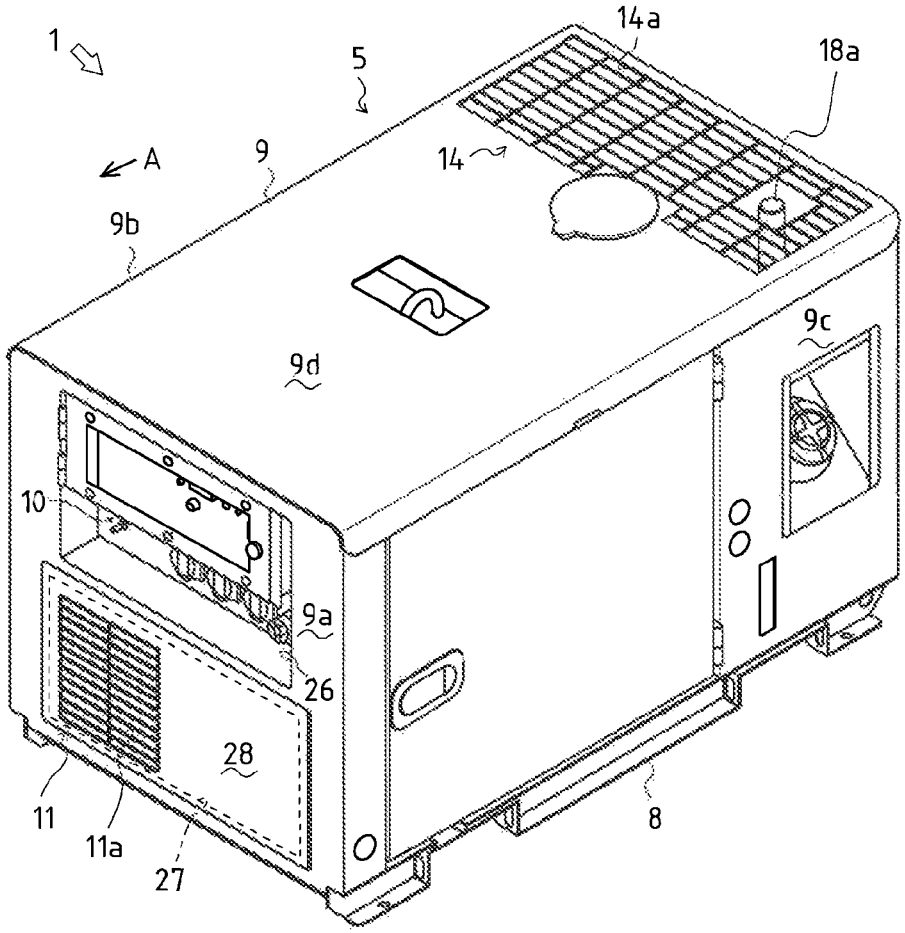
FIG. 1 is a perspective view of a housing of an engine generator, illustrating an external configuration of the housing.

1 Engine generator
2 Engine
3 Generator
4 Inverter
5 Housing
6 Radiator
7 Fuel tank
11 Second cooling air inlet
12 First cooling air inlet
12A Upper first cooling air inlet
12B Lower first cooling air inlet
13 Support
14 Cooling air outlet
16 Air cleaner
18 Muffler
23 Partition
25 Guiding member
31 First duct
32 Second duct

DESCRIPTION OF EMBODIMENTS

Next, embodiments of the present invention will be described.

Figure 2:
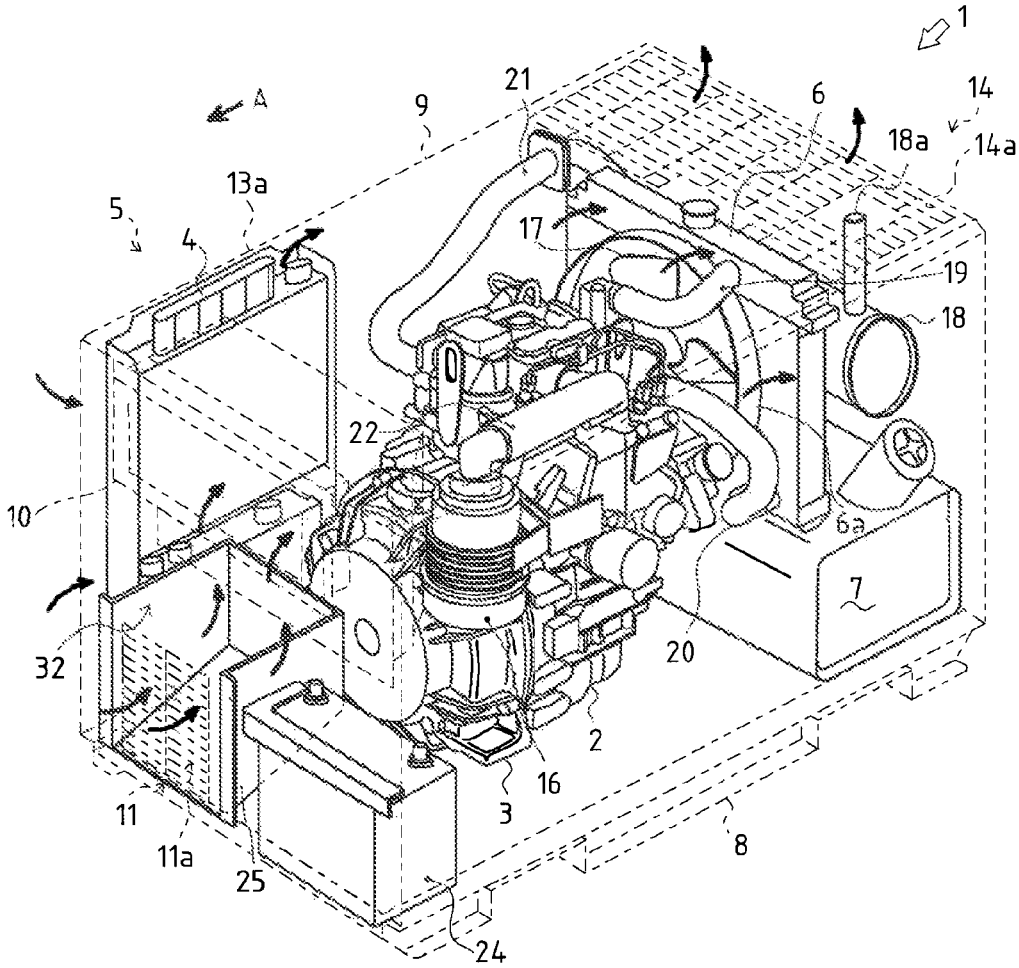
FIG. 2 is a perspective view of the housing of the engine generator, illustrating an internal configuration of the housing.
Figure 3:
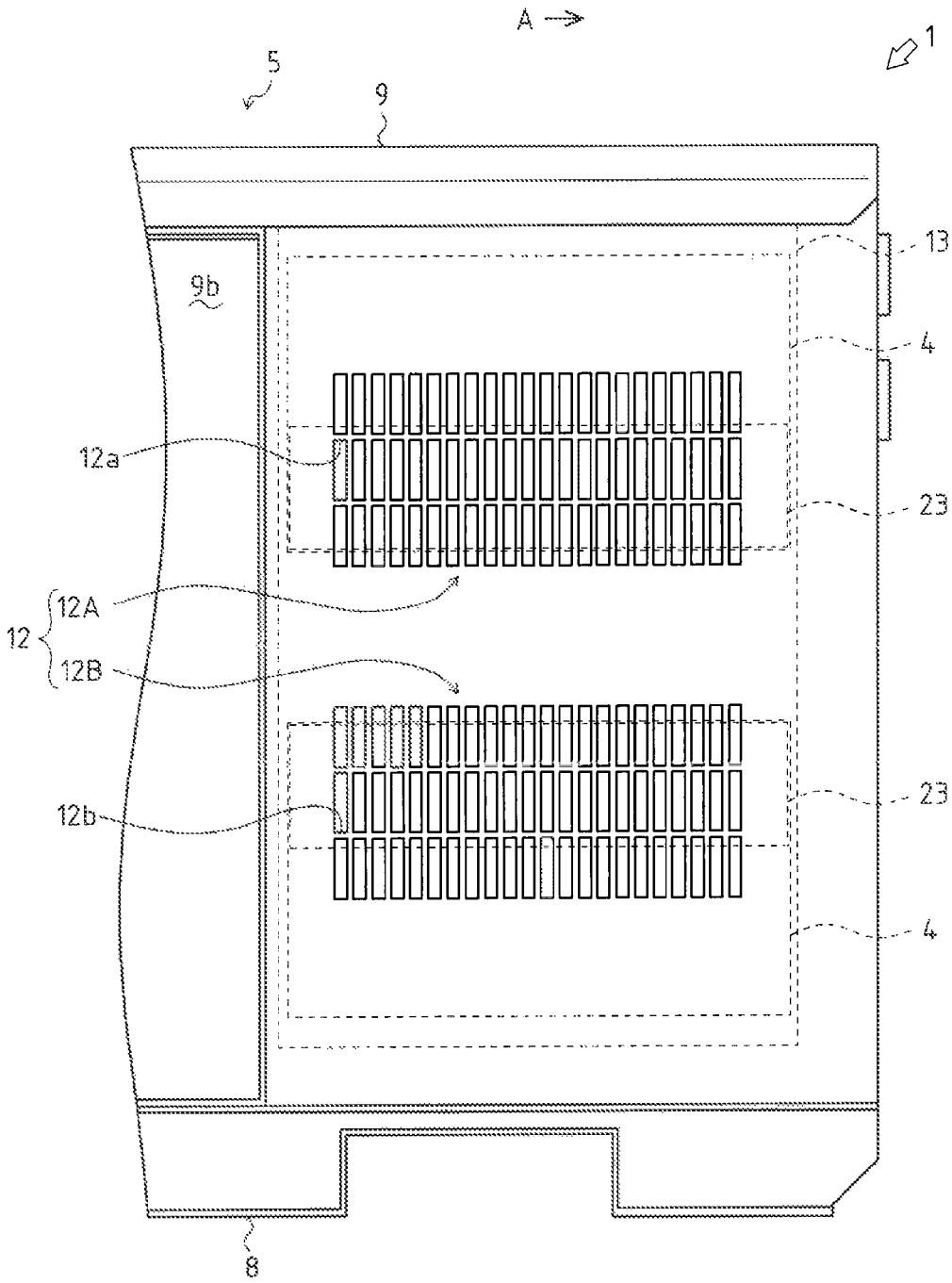
FIG. 3 is a side view of a right side of the housing, illustrating a partial configuration of the right side.
Figure 4:
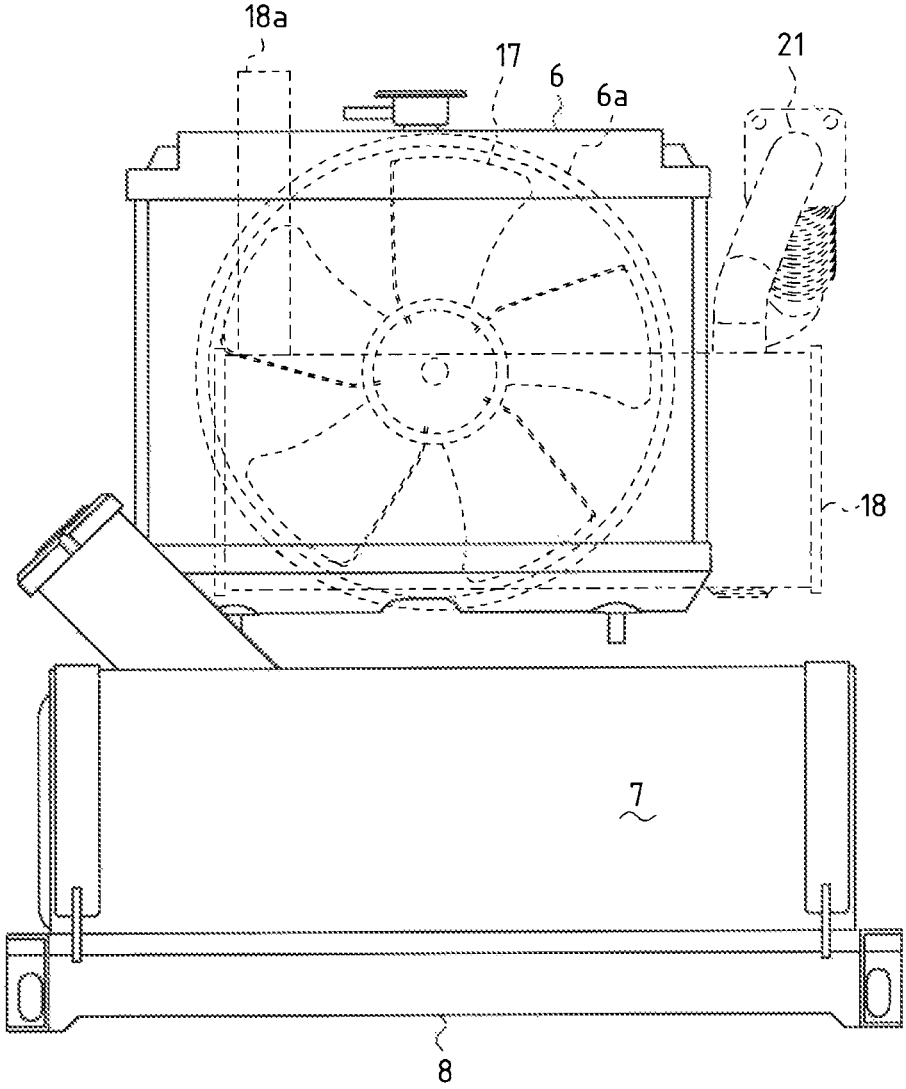
FIG. 4 is a rear view of the housing, illustrating a rear side configuration of the interior of the housing.
Figure 5:
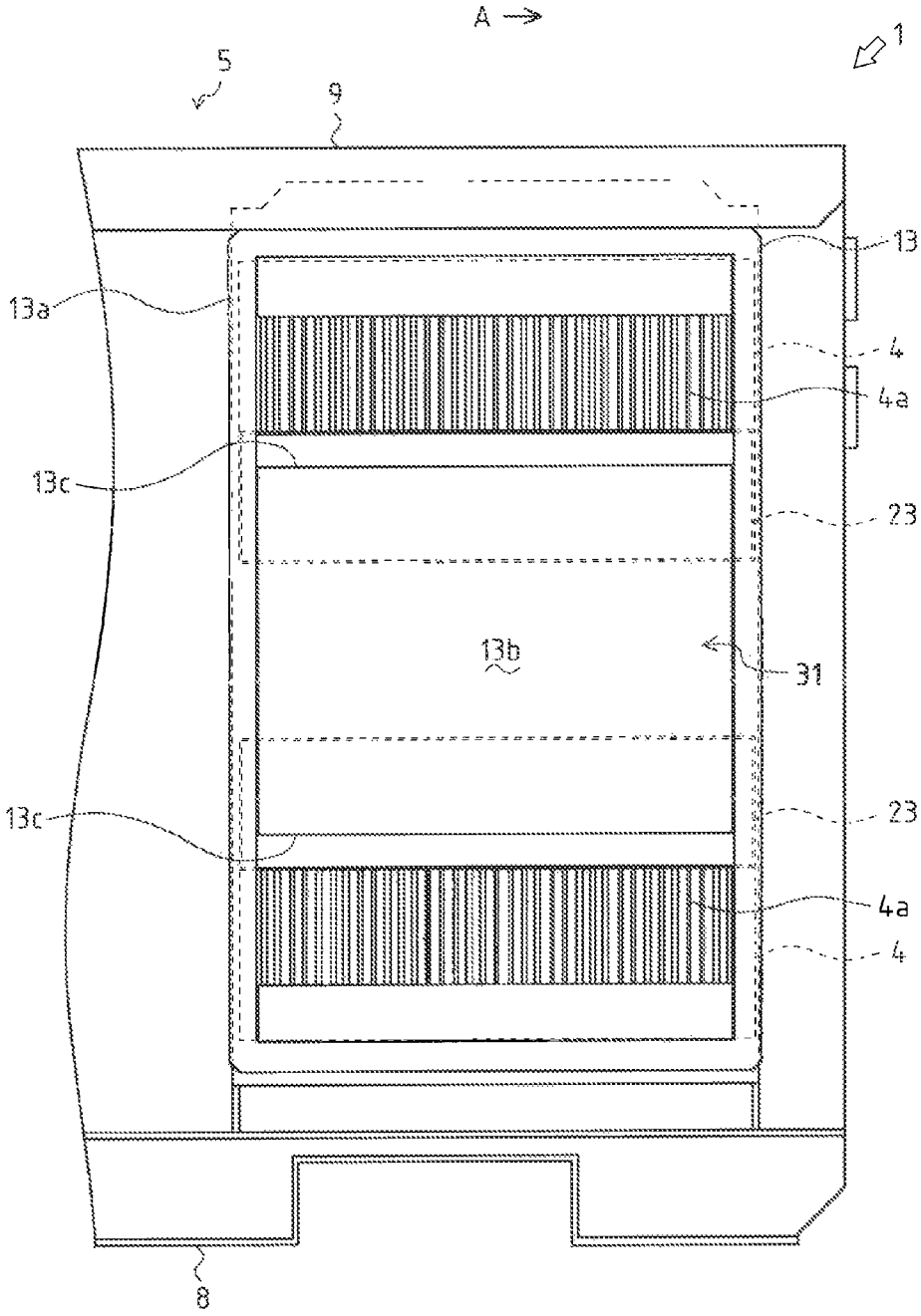
FIG. 5 is a side view of the housing, illustrating a configuration around a forward portion of the right side of the housing.
Figure 6:
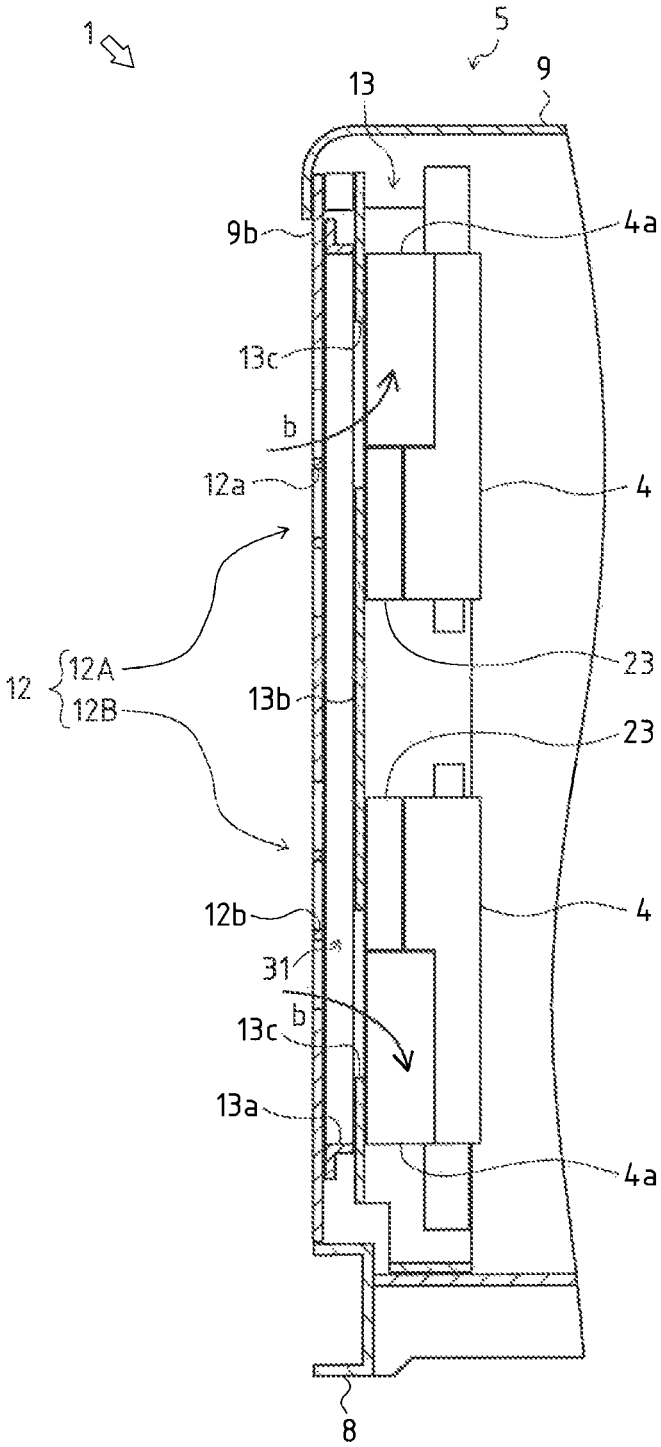
FIG. 6 is a front cross-sectional view, illustrating a configuration around the forward portion of the right side of the housing.
Figure 7:
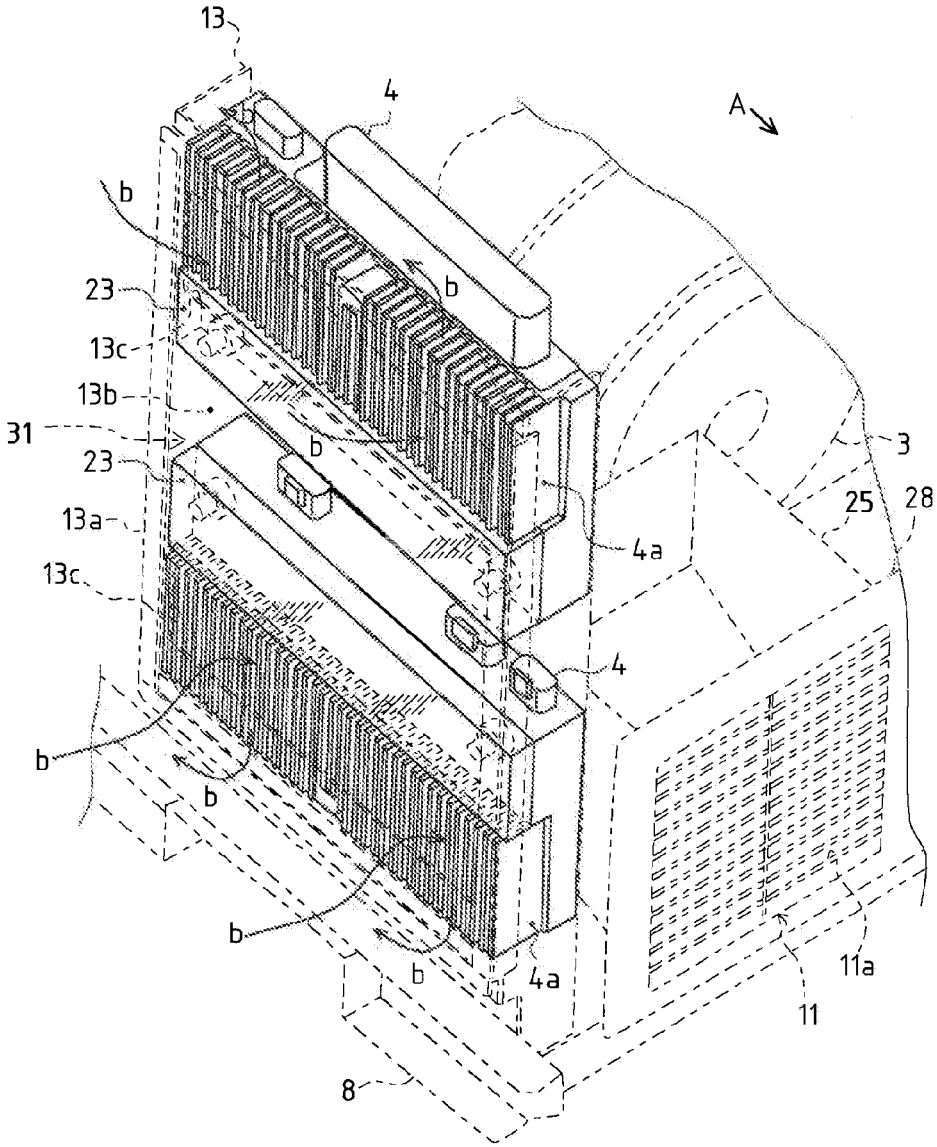
FIG. 7 is a perspective view of the housing, illustrating a configuration around a forward portion of the right side of the housing.
Figure 8:
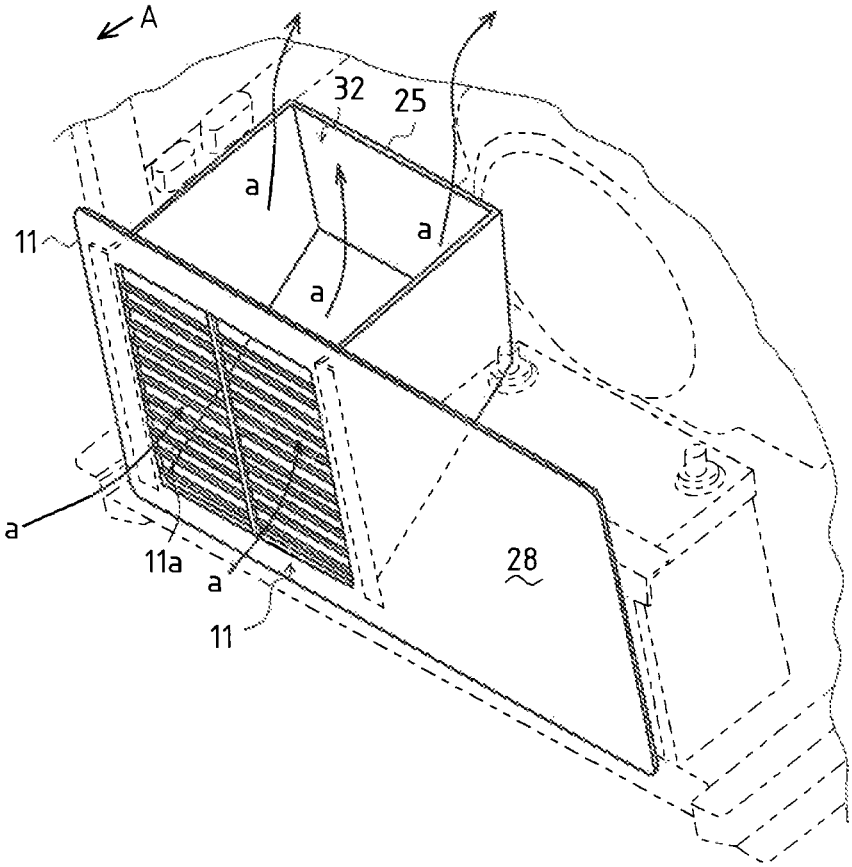
FIG. 8 is a perspective view of the housing, illustrating a configuration around a front side of the housing.

FIG. 1 is a perspective view of a housing of an engine generator, illustrating an external configuration of the housing; FIG. 2 is a perspective view of the housing of the engine generator, illustrating an internal configuration of the housing; FIG. 3 is a side view of a right side of the housing, illustrating a partial configuration of the right side; FIG. 4 is a rear view of the housing, illustrating a rear side configuration of the interior of the housing; FIG. 5 is a side view of the housing, illustrating a configuration around a forward portion of the right side of the housing; FIG. 6 is a front cross-sectional view, illustrating a configuration around the forward portion of the right side of the housing; FIG. 7 is a perspective view of the housing, illustrating a configuration around a forward portion of the right side of the housing; and FIG. 8 is a perspective view of the housing, illustrating a configuration around a front side of the housing.

First, description will be given with regard to the general arrangement of an engine generator 1 according to an embodiment of the present invention. It should be noted that the arrows A shown in the drawings, where necessary, are assumed as front directions on which definition of forward/rearward directions and right/left directions is based.

As shown in FIG. 1 and FIG. 2, the engine generator 1 is an engine generator of an inverter type. The engine generator 1 includes a housing 5, an engine 2, a generator 3, an inverter 4, a cooling fan 17, a radiator 6, a fuel tank 7, an air cleaner 16, a muffler 18, a control device, and a battery 24.

The housing 5, which is a package of the engine generator 1, accommodates the components such as the engine 2 and the generator 3. The housing 5 includes a base 8 at bottom and a cover 9 on top.

The engine 2 serves as a driving source for the components in the housing 5. The engine 2 is disposed approximately at the center on the interior of the housing 5, and supported on the upper surface of the base 8 through an antivibration member, not shown.

The generator 3 is powered by the engine 2 to generate electrical power. The generator 3 is disposed further forward than the engine 2 and further rearward than the battery 24.

The inverter 4 rectifies the electrical power generated by the generator 3 and then converts the rectified electrical power into alternate-current electrical power of a predetermined frequency to output the alternate-current electrical power. The inverter 4 is disposed in the right-forward direction relative to the engine 2 and disposed on the right side of the housing 5, that is, adjacent to a forward portion of a right plate 9*b* of the cover 9.

The cooling fan 17 incorporates ambient air into the housing 5. The cooling fan 17 is disposed in the housing 5 further rearward than the engine 2 and further forward than the radiator 6, and is powered by the engine 2.

The radiator 6 cools coolant to be circulated within the engine 2. The radiator 6 is disposed in the housing 5 further rearward than the cooling fan 17 and further upward than the fuel tank 7, and is coupled to the engine 2 through communication pipes 19 and 20.

The fuel tank 7 stores fuel to be supplied to the engine 2. The fuel tank 7 is disposed approximately further rearward than the engine 2 and further downward than the radiator 6.

The air cleaner 16 purifies ambient air and supplies the purified ambient air to the engine 2. The air cleaner 16 is disposed approximately in the left-forward direction relative to the engine and further upward than the battery 24, and is coupled to the engine 2 through an inlet pipe 22.

The muffler 18 deadens exhaust noise of the engine 2. The muffler 18 is disposed further rearward than the radiator 6 and further upward than the fuel tank 7, and is coupled to the engine 2 through a discharge pipe 21.

The muffler 18 extends a tail pipe 18*a* upward adjacent to the ceiling of the housing, that is, adjacent to a ceiling plate 9*d* of the cover, with the tail pipe 18*a* communicating with ambient at an extension end. This ensures that discharge gas of the engine 2 is discharged to outside the housing 5 through the tail pipe 18*a* by way of the discharge pipe 21 and the muffler 18.

The control device controls the engine 2 and the generator 3. The control device is disposed further forward than the generator 3 and further upward than the battery 24, and disposed adjacent to the front side of the housing 5, that is, adjacent to a forward portion of a front plate 9*a* of the cover 9.

A control panel 10 is used to operate the engine generator 1 such as for start-up and to display driving conditions and other conditions. The control panel 10 is disposed further forward than the control device, and exposed to ambient at the front side of the housing 5, that is, at an upper portion of the front plate 9*a* of the cover 9. The control panel 10 includes switches and similar devices to operate driving of the engine generator 1 and a monitor or a similar device to display driving conditions of the engine generator 1.

The battery 24, at the start-up of the engine 2, supplies electrical power to a starter, not shown, to a controller of the inverter 4, to the control panel 10, described later, and to other components. The battery 24 is disposed on a forward portion of the base 8.

Thus, the housing 5 accommodates the components of the engine generator 1. The engine 2 starts when fueled by the fuel tank 7 and supplied with air through the air cleaner 16. The power of the engine 2 drives the generator 3 to generate electrical power. The inverter 4 rectifies the electrical power generated by the generator 3, they converts the rectified electrical power into alternate-current electrical power of a predetermined frequency, and outputs the alternate-current electrical power.

Next, description will be given in detail with regard to the housing 5 and its internal configuration.

As shown in FIG. 1, FIG. 2, and FIG. 3, the housing 5 includes the base 8 and the cover 9, as described above. The base 8 is disposed at the bottom of the housing 5 and is rectangular in plan view. The cover 9 is disposed at the top of the housing 5 in the form of a cubic box having an opening oriented downward, and covered by the base 8 from the downward direction.

A second cooling air inlet 11 is disposed on the front side of the housing 5, that is, on the front plate 9*a* of the cover 9. The second cooling air inlet 11 includes a group of openings 11*a* and is disposed at a lower right portion of the front plate 9*a*. The second cooling air inlet 11 provides communication between ambient and the interior of the housing 5. This ensures that upon driving of the cooling fan 17 by the engine 2, ambient air is incorporated into the housing 5 as cooling air.

Upper and lower first cooling air inlets 12 are disposed on the right side of the housing 5, that is, on a right plate of the cover 9. The upper first cooling air inlet 12A includes a group of openings 12*a* and is disposed at an upper forward portion of the right plate. The lower first cooling air inlet 12B includes a group of openings 12*b* and is disposed at a lower forward portion of the right plate, that is, further downward than the upper first cooling air inlet 12A. The first cooling air inlets 12 provide communication between ambient and the interior of the housing 5. This ensures that upon driving of the cooling fan 17 by the engine 2, ambient air is incorporated into the housing 5 as cooling air.

A cooling air outlet 14 is disposed on the ceiling (top side) of the housing 5, that is, on a ceiling plate 9*d* of the cover 9. The cooling air outlet 14 includes a group of openings 14*a* and is disposed at a rearward portion of the ceiling plate 9*d*. The cooling air outlet 14 provides communication between the interior of the housing 5 and ambient. This ensures that upon driving of the cooling fan 17 by the engine 2, cooling air incorporated in the housing 5 is discharged to outside the housing 5.

In the housing 5, a cooling air passage is defined between the upper and lower first cooling air inlets 12A and 12B and the cooling air outlet 14 to extend in the forward/rearward directions. Likewise, another cooling air passage is defined between the second cooling air inlet 11 and the cooling air outlet 14 to extend in the forward/rearward directions. Thus, cooling air incorporated through the upper and lower first cooling air inlets 12A and 12B or through the second cooling air inlet 11 flows through the corresponding cooling air passage to the cooling air outlet 14.

The engine 2 is disposed along the length of the cooling air passages. The engine 2 is disposed approximately at the center inside the housing 5, with the axial direction of the crank shaft assumed the forward/rearward direction. The space further forward than the engine 2 is defined as the upstream of each cooling air passage, while the space further rearward than the engine 2 is defined as the downstream of each cooling air passage.

The generator 3, the inverter 4, and the air cleaner 16 are disposed on the upstream of each cooling air passage as if to surround the engine 2 from the forward direction. On the upstream of each cooling air passage, the generator 3 is disposed further forward than the engine 2 and slightly forward relative to the center inside the housing 5 to be adjacent to the second cooling air inlet 11. The generator 3 is linkably coupled to the crank shaft that protrudes forward from the forward portion of the engine 2.

The inverter 4 is disposed at a right forward portion inside the housing 5 in the right-forward direction relative to the engine 2. The inverter 4 is disposed opposite the upper and lower first cooling air inlets 12A and 12B adjacent to the right plate 9*b* of the cover 9. The inverter 4 of this embodiment includes two, upper and lower inverters 4 and 4, with the upper inverter 4 opposite the upper first cooling air inlet 12A and the lower inverter 4 opposite the lower first cooling air inlet 12B. The upper and lower inverters 4 and 4 are attached to the housing 5 through a support 13, described later.

The air cleaner 16, with its longitudinal side oriented in the vertical direction, is disposed at an upper left forward portion inside the housing 5 in the left-forward direction relative to the engine 2. The air cleaner 16 is disposed adjacent to the second cooling air inlet 11 adjacent to a left plate 9*c* of the cover 9. The air cleaner 16 is coupled to the inlet side of the engine 2 at an uppermost portion of the air cleaner 16 through an inlet pipe 22 that extends in the forward/rearward direction inside the housing 5.

Meanwhile, the fuel tank 7, the radiator 6, and the muffler 18 are disposed on the downstream side of each cooling air passage as if to surround the engine 2 from the rearward direction. On the downstream side of each cooling air passage, the fuel tank 7 is disposed lower and further rearward than the engine 2 on the rearward side in the housing 5. The fuel tank 7 is disposed further downward than the cooling air outlet 14. As also shown in FIG. 4, the fuel tank 7 has its longitudinal side oriented in the lateral direction, that is, oriented in the right/left direction, and is in the form of a laterally long cubic box that extends throughout the lateral direction of the housing 5.

The radiator 6 is disposed further rearward than the engine 2 on the rearward side in the housing 5. The radiator 6 is disposed further downward than the cooling air outlet 14. As also shown in FIG. 4, the radiator 6 has its longitudinal side oriented in the lateral direction, that is, oriented in the right/left direction, and has a laterally long shape similarly to the fuel tank 7, which extends in the lateral direction. The radiator 6 is disposed approximately further upward than and in parallel to the fuel tank 7. The radiator 6 includes a cylindrical fan cover 6*a* that is integral to the forward side of the radiator 6 to cover the cooling fan 17.

The muffler 18 is disposed further rearward than the engine 2 on the rearward side in the housing 5. The muffler 18 is disposed further downward than the cooling air outlet 14. The muffler 18 has its longitudinal direction oriented in the lateral direction, that is, oriented in the right/left direction, and extends in the lateral direction. The muffler 18 has a laterally long shape similarly to the fuel tank 7, and is disposed in parallel to the fuel tank 7 and the radiator 6 at a portion that is further upward than the fuel tank 7 and further rearward than the radiator 6. The muffler 18, at its upper right portion, is coupled to the discharge side of the engine 2 through the discharge pipe 21, which extends in the forward/rearward direction on the right side in the housing 5.

This configuration ensures that upon driving of the cooling fan 17 by the engine 2, ambient air is incorporated as cooling air into the housing 5 through the first cooling air inlets 12 and the second cooling air inlet 11. The cooling air incorporated through the first cooling air inlets 12 first flows toward the inverters 4 and 4, which are located on the upstream side of each cooling air passage. Then, the cooling air flows toward the radiator 6 and other components located along the corresponding cooling air passage through the vicinity of the engine 2, the discharge pipe 21, and other components. Finally, the cooling air is discharged to outside the housing 5 through the cooling air outlet 14.

The cooling air incorporated through the second cooling air inlet 11 first flows toward the generator 3 and the air cleaner 16 located on the upstream side of each cooling air passage. Then, the cooling air flows toward the radiator 6 and other components located along the cooling air passage through the vicinity of the engine 2 and other components. Finally, the cooling air is discharged to outside the housing 5 through the cooling air outlet 14. Thus, ambient air is incorporated as cooling air into the housing 5 through the first cooling air inlets 12 and the second cooling air inlet 11; flows from the upstream toward downstream of each cooling air passage while sequentially cooling the inverters 4 and 4, the air cleaner 16, and other components that particularly need cooling; and is discharged to outside the housing 5 through the cooling air outlet 14.

Next, description will be given with regard to a configuration around the forward portion of the right side of the housing 5.

As shown in FIG. 3, FIG. 5, FIG. 6, and FIG. 7, the housing 5 at the right side, more specifically, at the forward portion of the right plate 9*b* of the cover 9, vertically has the upper first cooling air inlet 12A, which includes the group of openings 12*a*, and the lower first cooling air inlet 12B, which includes the group of openings 12*b*, as described above. The upper first cooling air inlet 12A and the lower first cooling air inlet 12B have the same shapes, and are disposed with a predetermined amount of space secured in the vertical direction between the upper first cooling air inlet 12A and the lower first cooling air inlet 12B.

The two inverters 4 and 4 are vertically disposed inside the housing 5 adjacent to the forward portion of the right plate 9*b* of the cover 9. The upper inverter 4 is disposed in parallel to the right plate 9*b* of the cover 9 as if to be opposite the upper first cooling air inlet 12A, while the lower inverter 4 is disposed in parallel to the right plate 9*b* of the cover 9 as if to be opposite the lower first cooling air inlet 12B. At the same time, the upper and lower inverters 4 and 4 are disposed with a predetermined amount of space secured therebetween along a common straight line extending in the vertical direction in front view.

The support 13 is disposed between the upper and lower inverters 4 and 4 and the right plate 9*b* of the cover 9. The support 13 includes an outer plate 13*b* and a frame 13*a*, and supports the upper and lower inverters 4 and 4. The outer plate 13*b* is disposed to interpose between the base 8 and the ceiling plate 9*d* of the cover 9. The outer plate 13*b* has its forward portion and rearward portion bent in the left direction as if to cover and surround the upper and lower inverters 4 and 4 from the forward and rearward directions and from the right direction. The frame 13*a* is attached to the outer plate 13*b* in contact with the right plate 9*b* of the cover 9.

The outer plate 13*b* includes upper and lower communication openings 13*c* and 13*c* respectively at an upper portion and a lower portion of the outer plate 13*b*. The upper and lower communication openings 13*c* and 13*c* are located further inward than the frame 13*a*. The upper and lower communication openings 13*c* and 13*c* each have a rectangular shape and are disposed respectively opposite the upper and lower first cooling air inlets 12 and the upper and lower inverters 4 and 4, particularly their heat sinks 4*a* and 4*a*. One of the heat sinks 4*a* and 4*a* is disposed on an upper side of a right surface of the upper inverter 4, while the other of the heat sinks 4*a* and 4*a* is disposed on a lower side of the right surface of the lower inverter 4.

Thus, in the support 13, a first duct 31 that constitutes the cooling air passage is defined by the space defined by the frame 13*a* between the right plate 9*b* and the outer plate 13*b*, the space defined by the outer plate 13*b* (the space defined by the outer plate 13*b* and the upper and lower inverters 4 and 4), and the upper and lower communication openings 13*c* and 13*c*, which communicate with these spaces. The first duct 31 is formed as if to extend from the upper and lower first cooling air inlets 12 toward the upper and lower inverters 4 and 4. The first duct 31 communicates with the first cooling air inlets 12 and with the internal space of the housing 5.

An upper partition 23 made of sponge or like material is disposed between the lower side of the right surface of the upper inverter 4 and the outer plate 13*b*. The upper partition 23 extends in the forward/rearward direction and is disposed further downward than the upper communication opening 13*c* with a similar lateral width to the width of the upper communication opening 13*c*. The upper partition 23 is in contact with the inverters 4 and 4 and the outer plate 13*b* at the lateral sides of the upper partition 23 and is in contact with the bending portions of the outer plate 13*b* at the forward/rearward sides of the upper partition 23. Thus, the upper partition 23 vertically blocks the space defined by the outer plate.

A lower partition 23 made of sponge or like material is disposed between the upper side of the right surface of the lower inverter 4 and the outer plate 13*b*. The lower partition 23 extends in the forward/rearward direction and is disposed further upward than the upper communication opening 13*c* with a similar lateral width to the width of the upper communication opening 13*c*. The lower partition 23 is in contact with the lower inverter 4 and the outer plate 13*b* at the lateral sides of lower partition 23 and is in contact with the bending portions of the outer plate 13*b* at the forward/rearward sides of the lower partition 23. The lower partition 23 vertically blocks the space defined by the outer plate 13*b*.

Thus, in the first duct 31, the upper partition 23 vertically partitions the space defined by the outer plate 13*b* to bring only the space above the upper partition 23 into communication with the space defined by the frame 13*a* through the upper communication opening 13*c*. Likewise, the lower partition 23 vertically partitions the space defined by the outer plate 13*b* to bring only the space below the lower partition 23 into communication with the space defined by the frame 13*a* through the lower communication opening 13*c*. This vertically splits the first duct 31 in the space defined by the outer plate 13*b*.

This configuration ensures that upon driving of the cooling fan 17 by the engine 2, ambient air is incorporated as cooling air into the housing 5 through the upper and lower first cooling air inlets 12 and allowed to flow into the first duct 31. As the arrows "b" shown in FIG. 6 and FIG. 7 indicate, the cooling air flows through the space defined by the frame 13*a* and diverges into the upper and lower communication openings 13*c* and 13*c*. Part of the cooling air flows through the upper communication opening 13*c* into the upper side of the space defined by the outer plate 13*b*, while the rest of the cooling air flows through the lower communication opening 13*c* into the lower side of the space defined by the outer plate 13*b*.

Among the vertically split cooling air, the cooling air through the upper communication opening 13*c* is guided in the space defined by the outer plate 13*b* to the heat sink 4*a* of the upper inverter 4, which is located on the upstream side of the cooling air passage, as the arrows "b" shown in FIG. 6 and FIG. 7 indicate. In this respect, since the upper partition 23 blocks the space defined by the outer plate 13*b* below the upper communication opening 13*c*, the downward flow of the cooling air is blocked. This secures that the cooling air is guided upward along the heat sink 4*a* and sent above the upper inverter 4 toward above the discharge pipe 21.

Among the vertically split cooling air, the cooling air through the lower communication opening 13*c* is guided in the space defined by the outer plate 13*b* to the heat sink 4*a* of the lower inverter 4, which is located on the upstream side of the cooling air passage, as the arrows "b" shown in FIG. 6 and FIG. 7 indicate. In this respect, since the lower partition 23 blocks the space defined by the outer plate 13*b* above the lower communication opening 13*c*, the upward flow of the cooling air is blocked. This secures that the cooling air is guided downward along the heat sink 4*a* and sent above the lower inverter 4 toward below the discharge pipe 21.

Next, description will be given with regard to a configuration around the front side of the housing 5.

As shown in FIG. 2 and FIG. 8, openings 26 and 27 each having a rectangular front are respectively disposed at an upper portion and a lower portion of the front side of the housing 5, that is, of the front plate 9*a* of the cover 9. The upper opening 26 is blocked by the control panel 10, while the lower opening 27 is blocked by a plate member 28. The plate member 28 is detachably attached to the front plate 9*a* as a part of the cover 9. The plate member 28 includes, on its right side, the above-described second cooling air inlet 11 including the group of openings 11*a*.

The plate member 28 also includes, on its right side, a guiding member 25 attached to the rear surface (the other surface) of the plate member 28. The guiding member 25 has a box form having an opening oriented upward and forward, that is, toward the second cooling air inlet 11. The guiding member 25 is disposed with the lower opening 27 opposite the second cooling air inlet 11. The bottom of the guiding member 25 is inclined in a "front low, rear high" manner.

The guiding member 25 has lateral and vertical dimensions greater than the lateral and vertical dimensions of the second cooling air inlet 11. The guiding member 25 covers the second cooling air inlet 11 from the rearward direction. Thus, a second duct 32 constituting the cooling air passage is defined in the guiding member 25 as if to extend from the second cooling air inlet 11 to an inner upper portion of the housing 5. The second duct 32 communicates with the second cooling air inlet 11 and with the internal space of the housing 5.

This configuration ensures that upon driving of the cooling fan 17 by the engine 2, ambient air is incorporated as cooling air into the housing 5 through the second cooling air inlet 11 and allowed to flow through the second duct 32. As the arrows "a" shown in FIG. 2 indicate, the cooling air is guided upward along the inclined bottom surface of the guiding member 25 and sent first toward the air cleaner 16 and the generator 3, which are located on the upstream side of the cooling air passage.

As described hereinbefore, the engine generator 1 according to the embodiment of the present invention includes the engine 2; the generator 3 driven by the engine 2 to generate electrical power; the inverter 4 configured to convert the electrical power generated by the generator 3 into an alternating current and to output the alternating current; the control device configured to control the engine 2 and the generator 3; the fuel tank 7 to store fuel to be supplied to the engine 2; the air cleaner 16 configured to purify air to be supplied to the engine 2; the muffler 18 configured to deaden exhaust noise of the engine 2; the radiator 6 configured to cool coolant for the engine 2; and the housing 5 accommodating the foregoing components. The cooling air inlets 11 and 12 are respectively disposed on the front and right sides of the housing 5, that is, on the front and right plates 9*a* and 9*b* of the cover 9, which correspond to a first side of the engine 2. The cooling air outlet 14 is disposed on the top side (ceiling) of the housing 5, that is, on the ceiling plate 9*d* of the cover 9, which corresponds to a second side of the engine 2. Cooling air passages are defined in the housing 5 between the cooling air inlets 11 and 12 and the cooling air outlet 14. The generator 3, the inverter 4, and the air cleaner 16 are disposed further upstream than the engine 2 along each cooling air passage, while the fuel tank 7, the radiator 6, and the muffler 18 are disposed further downstream than the engine 2 along each cooling air passage. Upon driving of the cooling fan 17 of the engine 2 by the engine 2, ambient air is incorporated as cooling air into the housing 5 through the cooling air inlets 11 and 12, allowed to flow from the upstream toward downstream of each cooling air passage, and discharged to outside the housing 5 through the cooling air outlet 14.

This ensures cooling of the inverter 4 and the air cleaner 16, which particularly need cooling, with cooling air of a relatively low temperature. This ensures efficient cooling of the components as necessary, resulting in an improved cooling effect realized by cooling air. Further, the other components are disposed as if to surround the engine 2. This ensures a compact arrangement of the other components, while reducing noise of the engine 2 with the other components utilized as sound barriers.

In the engine generator 1 according to the embodiment of the present invention, the cooling air inlets 11 and 12 include the upper and lower first cooling air inlets 12 vertically disposed on a first side of the housing 5. The two inverters 4 and 4 are vertically disposed inside the housing 5 in parallel to the first side of the housing 5 as if to be opposite the upper and lower first cooling air inlets 12. The support 13 is disposed between and in parallel to the upper and lower inverters 4 and 4 and the first side of the housing 5. The first duct 31 constituting the cooling air passage is defined in the support 13 as if to extend from the upper and lower first cooling air inlets 12 toward the upper and lower inverters. The cooling air through the first cooling air inlet 12 is allowed to flow into the first duet 31 and guided upward and downward along the upper and lower inverters 4.

This ensures that the cooling air is sent through the first duct 31 toward the upper and lower inverters 4 and 4. This in turn ensures efficient cooling of the upper and lower inverters 4 and 4 with the cooling air, resulting in an improved cooling effect realized by cooling air. Further, the first duct 31 forms a duct structure inside the first cooling air inlets 12. This reduces leakage of noise to outside the housing 5 through the first cooling air inlets 12.

In the engine generator 1 according to the embodiment of the present invention, the partition 23 is disposed inside the first duct 31 to vertically split the cooling air through the first cooling air inlets 12. Part of the cooling air flowing in the first duct 31 is guided upward along the upper inverter 4, while the rest of the cooling air flowing in the first duct 31 is guided downward along the lower inverter 4.

This vertically splits the cooling air into the upper and lower inverters 4 and 4, while securing equal volumes of cooling air sent toward the upper and lower inverters 4 and 4. This ensures that the cooling air uniformly cools the upper and lower inverters, thus reducing uneven effectiveness of the cooling utilizing cooling air.

In the engine generator 1 according to the embodiment of the present invention, the cooling air inlets 11 and 12 include the second cooling air inlet 11 disposed on the lower side of a third side of the housing 5, that is, of the front plate 9*a* of the cover 9. The guiding member 25 is disposed inside the housing 5 in a box form having an opening oriented upward and toward the second cooling air inlet 11. The guiding member 25 is disposed in parallel to the lower side of the third side of the housing 5 as if to be opposite the second cooling air inlet 11. The second duct 32 constituting the cooling air passage is disposed in the guiding member 25 as if to extend from the second cooling air inlet 11 to the inner upper portion of the housing 5. The second cooling air inlet 11 communicates with the second duct 32 to allow cooling air through the second cooling air inlet 11 to flow into the second duct 32 and guide the cooling air upward along the guiding member 25.

Thus, the second duct 32 forms a duct structure inside the second cooling air inlet 11. This reduces leakage of noise to outside the housing 5 through the second cooling air inlet 11.

In the engine generator 1 according to the embodiment of the present invention, the radiator 6 is disposed in parallel to the fuel tank 7 with the longitudinal side of the radiator 6 oriented in the lateral direction and aligned to the longitudinal side of the fuel tank 7.

This ensures as much cooling capacity of the radiator 6 as desired and increases the capacity of the fuel tank 7, while ensuring a compact arrangement of the radiator 6 and the fuel tank 7 in the housing 5.

INDUSTRIAL APPLICABILITY

The present invention is applicable to internal structures of engine generators including engines and generators driven by the engines, particularly to internal structures for enhancing the efficiency of cooling inverters and air cleaners to which cooling needs to be effected.

The invention claimed is:

1. An engine generator comprising:

an engine;

a generator driven by the engine to generate electrical power;

at least one inverter configured to convert the electrical power generated by the generator into an alternating current and to output the alternating current;

a control device configured to control the engine and the generator;

a fuel tank to store fuel to be supplied to the engine;

an air cleaner configured to purify air to be supplied to the engine;

a muffler configured to deaden exhaust noise of the engine;

a radiator configured to cool coolant for the engine; and a housing accommodating the foregoing components, wherein at least one cooling air inlet is disposed on a first side of the housing corresponding to a first side of the engine, wherein a cooling air outlet is disposed on a second side of the housing corresponding to a second side of the engine, wherein a cooling air passage is disposed in the housing between the at least one cooling air inlet and the cooling air outlet, wherein the generator, the inverter, and the air cleaner are disposed further upstream than the engine along the cooling air passage, wherein the fuel tank, the radiator, and the muffler are disposed further downstream than the engine along the cooling air passage, wherein upon driving of a cooling fan of the engine by the engine, ambient air is incorporated as cooling air into the housing through the at least one cooling air inlet, allowed to flow from an upstream toward a downstream of the cooling air passage, and discharged to outside the housing through the cooling air outlet, wherein the at least one cooling air inlet comprises upper and lower first cooling air inlets respectively on upper and lower portions of the first side of the housing, wherein the at least one inverter comprises two, upper and lower inverters in the housing and in parallel to the first side of the housing, the upper and lower inverters respectively being opposite the upper and lower first cooling air inlets, wherein a support is disposed between and in parallel to the upper and lower inverters and the first side of the housing, wherein the support comprises a first duct constituting the cooling air passage, the first duct extending from the upper and lower first cooling air inlets toward the upper and lower inverters, and wherein the cooling air is allowed to flow through the at least one cooling air inlet into the first duct and is guided upward and downward along the upper and lower inverters.

2. The engine generator according to claim 1, further comprising a partition in the first duct to vertically split the cooling air from the upper and lower first cooling air inlets, wherein part of the cooling air flowing into the first duct is guided upward along the upper inverter, and wherein a rest of the cooling air flowing into the first duct is guided downward along the lower inverter.

3. The engine generator according to claim 1, wherein the radiator is disposed in parallel to the fuel tank with a longitudinal side of the radiator oriented in a lateral direction and aligned to a longitudinal side of the fuel tank.

4. An engine generator comprising:

an engine;

a generator driven by the engine to generate electrical power;

at least one inverter configured to convert the electrical power generated by the generator into an alternating current and to output the alternating current;

a control device configured to control the engine and the generator;

a fuel tank to store fuel to be supplied to the engine;

an air cleaner configured to purify air to be supplied to the engine;

a muffler configured to deaden exhaust noise of the engine;

a radiator configured to cool coolant for the engine; and a housing accommodating the foregoing components, wherein at least one cooling air inlet is disposed on a first side of the housing corresponding to a first side of the engine, wherein a cooling air outlet is disposed on a second side of the housing corresponding to a second side of the engine, wherein a cooling air passage is disposed in the housing between the at least one cooling air inlet and the cooling air outlet, wherein the generator, the inverter, and the air cleaner are disposed further upstream than the engine along the cooling air passage, wherein the fuel tank, the radiator, and the muffler are disposed further downstream than the engine along the cooling air passage, wherein upon driving of a cooling fan of the engine by the engine, ambient air is incorporated as cooling air into the housing through the at least one cooling air inlet, allowed to flow from an upstream toward a downstream of the cooling air passage, and discharged to outside the housing through the cooling air outlet, wherein the at least one cooling air inlet comprises a second cooling air inlet at a lower portion of a third side of the housing, wherein a guiding member in box form is disposed in the housing in parallel to the lower portion of the third side of the housing and opposite the second cooling air inlet, the guiding member having an opening oriented upward and toward the second cooling air inlet, wherein the guiding member comprises a second duct constituting the cooling air passage, the second duct extending from the second cooling air inlet to an upper portion of an interior of the housing, and wherein the second cooling air inlet and the second duct communicate with one another to allow cooling air from the second cooling air inlet to flow into the second duct and be guided upward along the guiding member.

5. The engine generator according to claim 4, wherein the radiator is disposed in parallel to the fuel tank with a longitudinal side of the radiator oriented in a lateral direction and aligned to a longitudinal side of the fuel tank.

* * * * *